US006830473B2

(12) United States Patent
Trainello

(10) Patent No.: US 6,830,473 B2
(45) Date of Patent: Dec. 14, 2004

(54) ELECTRICAL CONNECTION AND WIRING OF SOCKETS

(75) Inventor: Jerry Salvatore Trainello, Sarasota, FL (US)

(73) Assignee: Jerry S. Trainello, Sarasota, FL (US)

( * ) Notice: Subject to any disclaimer, the term of this patent is extended or adjusted under 35 U.S.C. 154(b) by 239 days.

(21) Appl. No.: 10/199,910

(22) Filed: Jul. 19, 2002

(65) Prior Publication Data

US 2003/0216081 A1 Nov. 20, 2003

Related U.S. Application Data

(60) Provisional application No. 60/381,861, filed on May 18, 2002.

(51) Int. Cl.[7] ..... H01R 11/20

(52) U.S. Cl. ..... 439/416; 439/226; 439/356; 439/428; 439/699.2; 439/727; 439/364

(58) Field of Search ..... 439/416, 419, 439/428, 429, 431, 697, 699.2, 727, 737, 771, 226, 356, 364

(56) References Cited

U.S. PATENT DOCUMENTS

| | | | | |
|---|---|---|---|---|
| 714,022 | A | | 11/1902 | Norden |
| 876,233 | A | | 1/1908 | Plas |
| 962,589 | A | | 6/1910 | Ryan |
| 1,171,471 | A | | 2/1916 | Smith |
| 1,283,107 | A | | 8/1918 | Anthony |
| 1,627,631 | A | | 5/1927 | Chizlett |
| 1,743,371 | A | | 3/1930 | Morey |
| 1,849,846 | A | | 3/1932 | McNeil |
| 2,726,373 | A | | 12/1955 | Bramming |
| 2,751,568 | A | | 6/1956 | Despard |
| 2,769,153 | A | | 10/1956 | Peronti |
| 2,869,101 | A | | 1/1959 | Benander |
| 4,653,829 | A | | 3/1987 | LaMont |
| 4,874,329 | A | | 10/1989 | Yu |
| 5,807,134 | A | | 9/1998 | Hara |
| 5,813,885 | A | * | 9/1998 | Shen ..... 439/699.2 |
| 5,816,844 | A | * | 10/1998 | Perera ..... 439/416 |
| 5,823,322 | A | | 10/1998 | Johnson |
| 5,860,830 | A | | 1/1999 | Wu |
| 5,967,823 | A | * | 10/1999 | Tsui ..... 439/280 |
| 6,547,582 | B2 | * | 4/2003 | Matsuba et al. ..... 439/339 |

* cited by examiner

*Primary Examiner*—Truc Nguyen

(57) ABSTRACT

An improved lamp socket assembly having a modified common metal screw shell riveted to an insulated base, connected to the screw shell is an elongated conductive strip that extends down the side of the insulated bas. A pair of contact screws being arranged oppositely vertically and horizontally offset from each other via a center of the insulated base so as not to interfere with each other when making electrical contact with conductor of lamp wires. The contact screws both penetrate an insulated layer of the wires without piercing through whereby causing the wire to bend and bulge for providing an electrical contact quickly and safely.

1 Claim, 6 Drawing Sheets

ELECTRICAL CONNECTION AND WIRING OF SOCKETS

CROSS-REFERENCE TO RELATED APPLICATIONS

This application claims the benefit of PPA Application No. 60/381,861 Filing Date May 18, 2002.

BACKGROUND OF THE INVENTION—FIELD OF INVENTION

This invention relates to electric lamp sockets, specifically to an improved Electrical connection and simple wiring.

BACKGROUND OF THE INVENTION

Socket assemblies are divided into switched or non-switched. Regardless of the type, anyone who has ever wired a socket is aware of how time consuming it is. Each half must be stripped of the insulation to expose the wires without cutting the individual wire strands. Each set of strands must be twisted. Then all strands of wire must be coiled around two screw terminals and screwed down firmly, with the hope of not to many strands of wire coming loose from under the screw head. If a lamp is being wired a knot is usually tied in the insulated wire at the base to prevent the wire connections from coming loose.

In recognition of these cumbersome, time consuming procedures several patents have attempted to address this problem.

U.S. Pat. No. 4,283,107 issued to Anthony, divulge a two-piece socket assembly with puncturing terminals protruding from the end of the sockets main body. A second cover piece is pivotally mounted on the body and closes over the puncture pins when said cover is screwed down over the wire.

U.S. Pat. No. 5,823,322 issued to Bates, embody a socket assembled without tools by inserting wire into a channel in the socket base. Then snap a rotatable switch actuator, which drives two pin sets into both sides of the wire.

The above patents require a complete redo of the socket. History has proven that change in a market place comes very slow.

Companies are hesitant to grasp any idea that requires a complete change of tooling and a big outlay of money. Especially in a market that does not recognize the need.

The present invention considers this, and makes use of certain parts of the socket. Such as the two piece Brass shell, screw shell and the cardboard insulating sleeve. The present invention is safer and easier to wire then what is being sold in stores today. Only requiring the insertion of the lamp wire and tightening the two screws. This connection will hold a 35-lb. weight for 24 hours or more without pulling apart or losing electrical connection.

The present invention eliminates the need to tie a knot in the insulated wire at the base of the lamp to prevent the electrical connection from coming loose.

SUMMARY OF THE INVENTION

It is accordingly a primary object of this invention to market and produce a novel lamp socket yet keeping the end cost in line with lamp sockets being sold to the public today.

It is another object of this invention to provide a novel socket assembly making use of certain existing parts of the socket that are known and presently sold in stores today, such as the two piece outer brass shell, the cardboard insulation and the screw shell.

It is yet another object of this invention to enable an electrical connection to be made quickly and conveniently with only the tightening of two screws.

A still further object of this invention is to provide a safer electrical connection. Other advantages and salient features of this invention will become clear from the following detailed description when read in conjunction with the accompanying drawings.

BRIEF DESCRIPTION OF THE DRAWINGS

FIG. 1 shows contact screw number 1 penetrating the lamp wire.

FIG. 2 is also a simplified elevation opposite of FIG. 1 showing contact screw number 2 penetrating the lamp wire.

FIG. 3 is a side elevation showing the two screws penetrating the lamp wire.

DRAWINGS—REFERENCE NUMERALS

10—screw shell, 12—center contact conductive strip, 14—screw shell conductive strip, 16—insulated base, 18—lamp wire, 20—contact screw, 22—contact screw opposite side, 24—screw hole, 26—screw hole opposite side, 28—channel for lamp wire, 30—front view of bulge, 32—side view of bulge, 34, 36—alternate layout contact screw, 38, 40—alternate layout lamp wire holes.

DETAILED DESCRIPTION OF THE INVENTION

Figure 1:
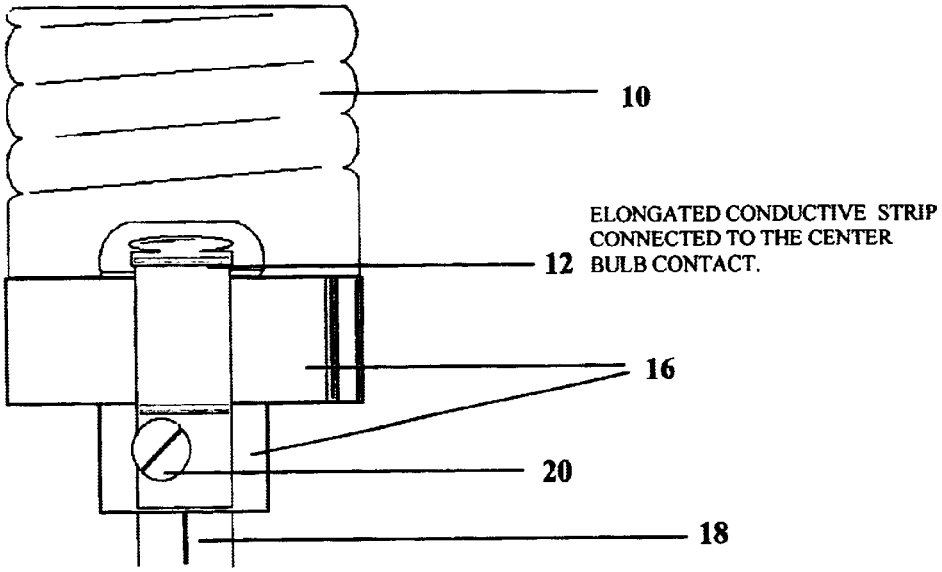
FIGS. 1–3 is a simplified elevation of a conventional lamp screw shell modified in accordance with the concept of the present invention.
Figure 2:
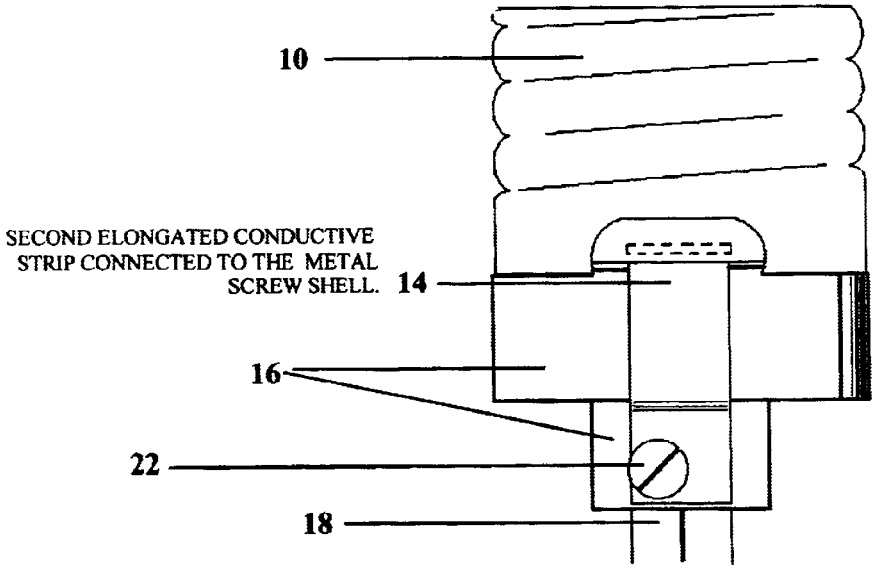
Figure 3:
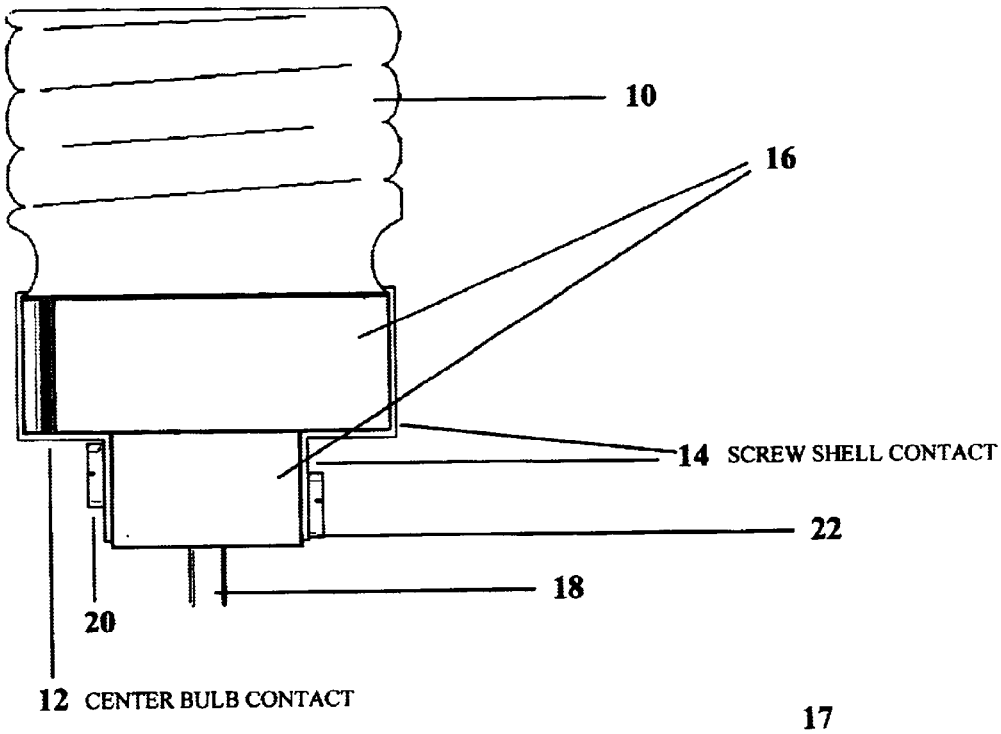
Figure 4:
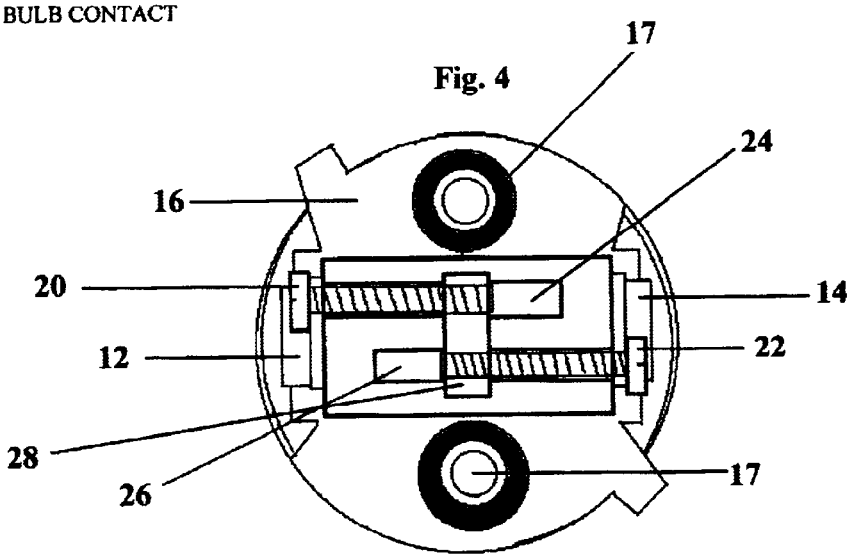
FIG. 4 is a bottom view of the socket and the close fitting channel for the lamp wire with the two penetrating screws.

Referring now to the drawings, the invention in one embodiment is shown generally in (FIG. 1 side view) and (FIG. 2 opposite side). A common metal screw shell 10 (FIGS. 1–3) the type used in present day assembly is riveted to an insulated base or disc 16 (FIGS. 1–5) with two rivets. The base is made of plastic or other insulating material. The bulb opening is defined by center contact 12 an elongated conductive strip of approximately 20 thousands of an inch thick and approximately 250 thousands of an inch wide that extends down the side of the base 16. Contact 12 has a hole to accommodate contact screw 20 this hole would be positioned above center to assure no interference with contact screw 22 in (FIG. 2 opposite view of FIG. 1). Contact screw 22 would be positioned below center to assure no interference with contact screw 20. Contact screws 20 and 22 both penetrate insulated lamp wire 18 shown in (FIGS. 1–3) making electrical contact from opposite directions. Contact 14 in (FIGS. 1–5) is connected to the base of the screw shell 10 and is also an elongated conductive strip extending down the side of the base 16 in the same manner as center contact 12 thereby completing the electrical connection. FIG. 4 (bottom view) shows the two penetrating screws and the close fitting channel 28 for the insertion of the insulated lamp wire (not shown) the channel is approximately three eighths of an inch deep. Contact screws 20 and 22 are of a thickness greater then the strands of lamp wire to provide a pressing as well as a penetrating result when making electrical contact. The results of the pressing and penetrating can be seen in (FIG. 5 sectional view).

The lamp wire 18 is being penetrated by contact screw 20 and at the same time being pressed into screw hole 24 causing a bulge and wedging effect. The effect on the insulated lamp wire due to the penetrating and pressing can be seen close-up in (FIG. 6) 30 is the lamp wire from the front view and 32 is the lamp wire from the side view, both showing the type of bulge caused by the contact screws pressing and wedging the back part of the insulated lamp wire further into the contact screw hole.

Figure 5:
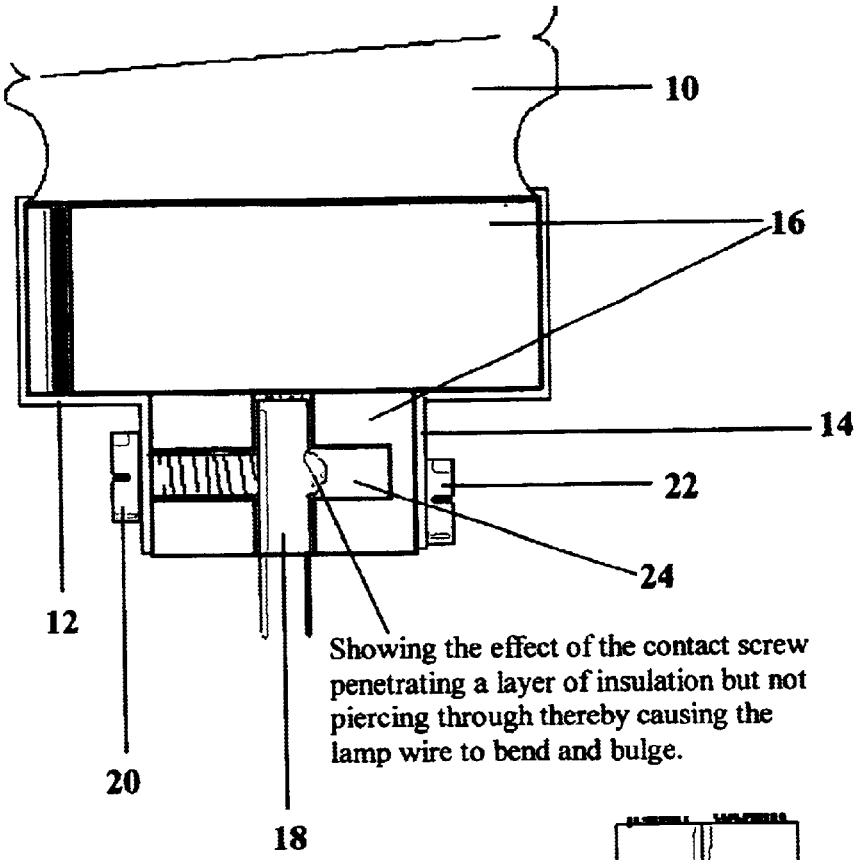
FIG. 5 is a sectional view showing the contact screw penetrating the lamp wire and at the same time causing a bulge in the wire.
Figure 6:
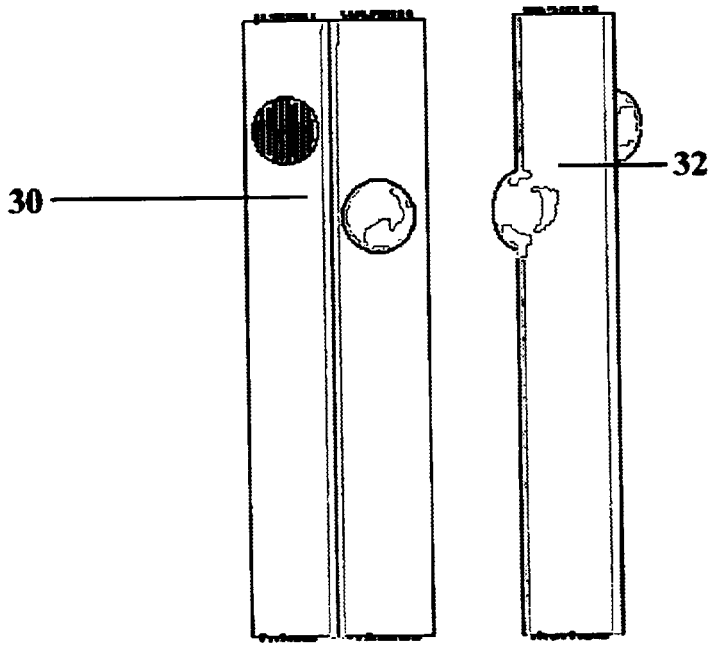
FIG. 6 is a detailed front and side view of the lamp wire and the effect of the screw penetrating the wire.

Accordingly, for the penetrating of the lamp wire and the bulge and wedging to exist as in FIG. 6 the contact screw must be a determined size and press the insulated lamp wire approximately three threads deep into the contact screw hole (as shown in FIG. 5). Whereby permitting a very secure and safe connection that will hold a 35-lb. weight in tension for 24 hours or more without pulling apart or losing electrical contact.

Advantages

From the description above, a number of advantages of my improved lamp socket become evident:

(a) Only requires a redo of the insulated base of the common socket being sold today, not a complete redo of the entire socket.

(b) Will fit into the standard two-piece brass shell, switched or non-switch.

(c) A competitive market price.

(d) Simple wiring only requiring the tightening of two screws.

(e) Safer, when the screw is tighten and the bulge is caused an electrical connection is made that will hold a 35-lb. weight in tension for 24 hours.

(f) Can easily be adapted for commercial lamp wiring by making the channel for the lamp wire larger.

(g) Eliminates the need to tie a knot out of the insulated wire at the base of the lamp for additional security.

(h) Substantially reduces the lamp manufactures and the public's assembly time.

(i) The wiring does not depend on the skill of the operator.

(j) The feeling of security when tightening the two screws home.

Conclusion, Ramifications, and Scope

Accordingly, the reader will see this invention is novel yet recognizable, although the benefits are many the cost will be in-line with lamp sockets being sold in stores today. It provides an improvement along with realistic cost and permits an otherwise sleepy industry to wake up and make room for further advances and benefits in the future for the public.

Although the description above is detailed, this should not be construed as limiting the scope of this invention but as merely providing illustrations of some of the presently preferred embodiments of this invention.

Figure 7:
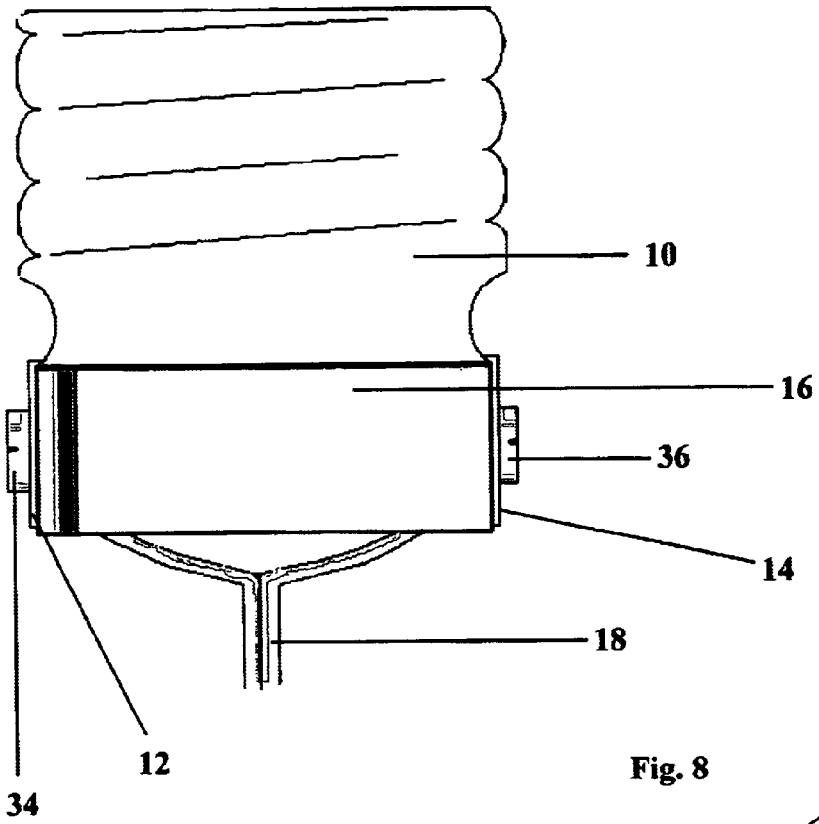
FIG. 7 is an alternate layout of the present invention with the lamp wire being split and inserted in a hole not a channel.
Figure 8:
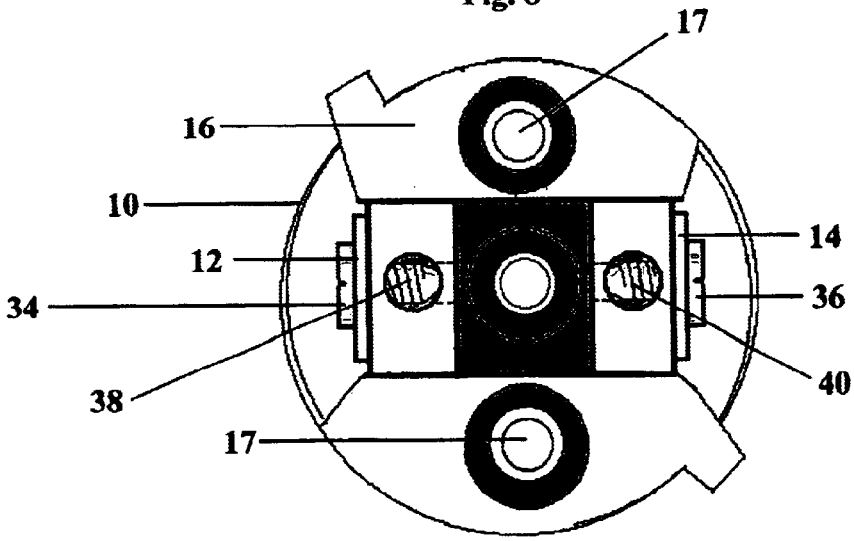
FIG. 8 is again the alternate layout showing the bottom sectional view of the socket and the two holes for the lamp wire, the two screws for making contact, minus the lamp wire.
Figure 9:
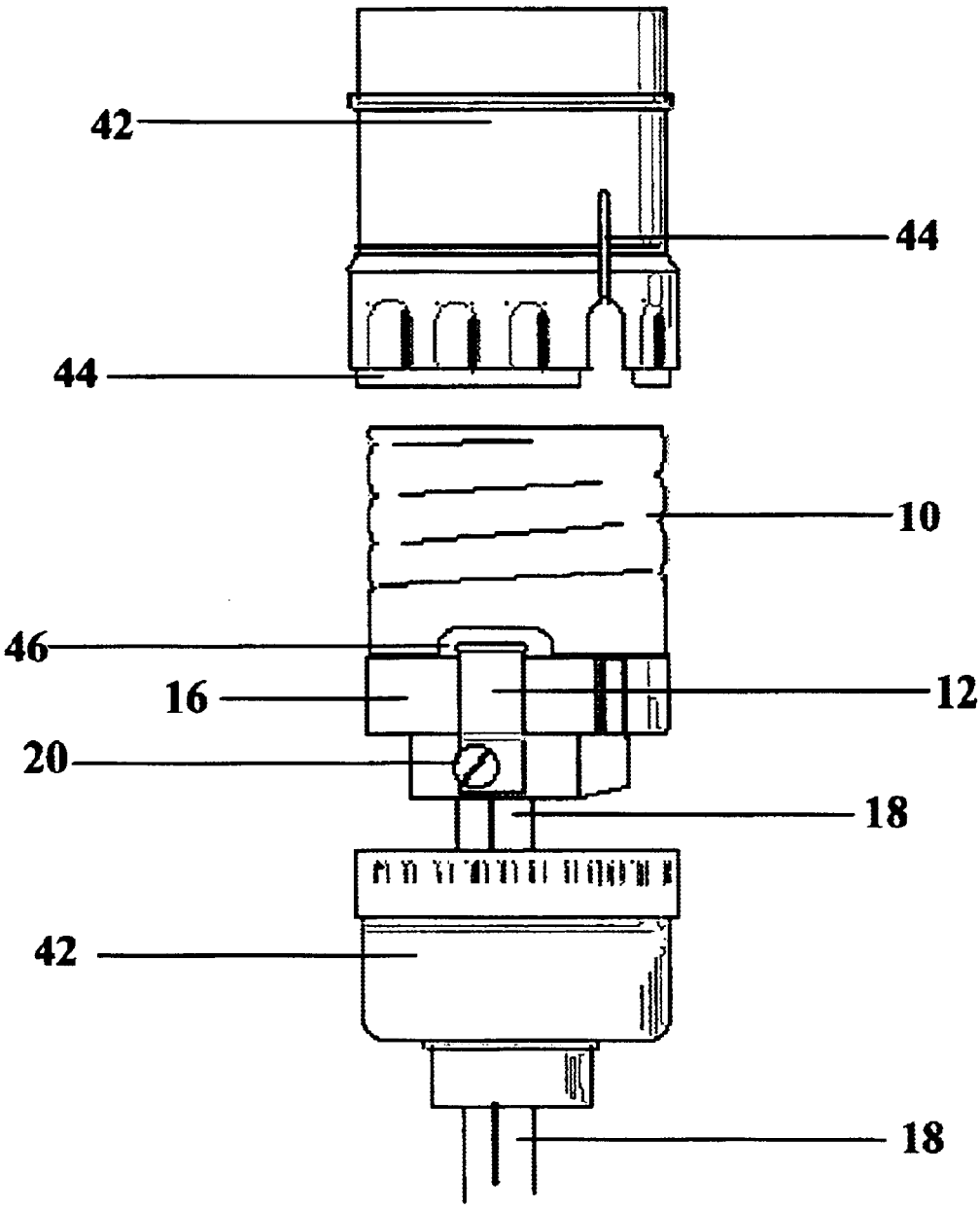
FIG. 9 is an exploded view of a common two piece brass socket shell. The cardboard insulating sleeve. Along with the common socket screw shell and insulated base modified n accordance with the present invention.
Figure 10:
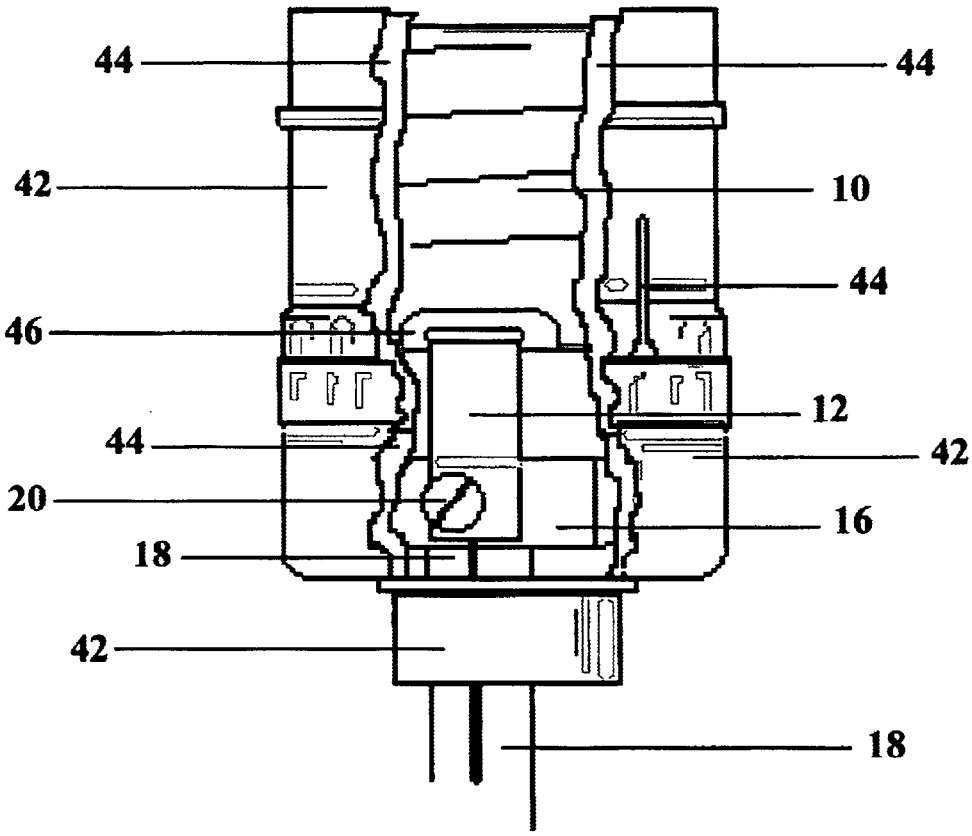
FIG. 10 is an enlarged broken view of a common two piece brass socket shell and the inner cardboard insulating sleeve with the common screw shell and insulated base modified in accordance with the present invention.

For example, FIG. 7, FIG. 8 show an alternate arrangement where the two conductive strips go straight down the sides of the insulated base similar to the above description. Contact is still made with two contact screws 34, 36 the difference being the lamp wire is split and is inserted in two holes 38, 40 not a channel.

Thus the appended claims and their legal equivalents should determine the scope of the invention, rather then by the examples given.

I claim:

1. An improved lamp socket comprising:

a two piece common brass shells;

a common metal screw shell rivet to an insulative base;

a pair of contact screws;

the insulative base having a first and second threaded screw holes located on a side and being arranged oppositely vertically and horizontally offset from each other via a center of the insulated base for preventing interference of the contact screws upon insertion into the threaded screw holes, and a closed fitting channel for insertion of an insulated lamp wire;

an elongated conductive strip being connected to the metal screw shell and having a first screw hole aligning to the first threaded screw hole and extending downwardly from the side of the insulative base; and an elongated strip center bulb contact having a second screw hole aligning to the second threaded screw hole and extending downwardly from the side of the insulative base opposite to the elongated conductive strip;

wherein the contact screws electrically contact the elongated conductive strip and the elongated strip center bulb contact via the screw holes and penetrating an insulative layer of the lamp wire without piercing through whereby causing the lamp wire to bend and bulge so that the lamp wire is firmly retaining in the closed fitting channel; and wherein upon insertion of the lamp wire in the channel and tightening of the two screw contacts providing an electrical contact quickly and safely.

* * * * *